US005576668A

United States Patent [19]

Clark et al.

[11] Patent Number: 5,576,668

[45] Date of Patent: Nov. 19, 1996

[54] TANDEM CIRCULAR POLARIZER

[75] Inventors: Robert T. Clark, Buena Park; Alan R. Keith, Fullerton, both of Calif.

[73] Assignee: Hughes Aircraft Company, Los Angeles, Calif.

[21] Appl. No.: 379,402

[22] Filed: Jan. 26, 1995

[51] Int. Cl.[6] ..... H01P 1/17

[52] U.S. Cl. ..... 333/21 A; 333/159

[58] Field of Search ..... 333/21 A, 157, 333/159

[56] References Cited

U.S. PATENT DOCUMENTS

| | | | |
|---|---|---|---|
| 2,438,119 | 3/1948 | Fox | 333/21 A X |
| 2,930,040 | 3/1960 | Weil | 333/21 A X |
| 5,075,649 | 12/1991 | Pellegrineschi | 333/21 A X |

FOREIGN PATENT DOCUMENTS

| | | | |
|---|---|---|---|
| 67803 | 3/1988 | Japan | 333/21 A |

*Primary Examiner*—Paul Gensler

*Attorney, Agent, or Firm*—E. E. Leitereg; T. Gudmestad; W. K. Denson-Low

[57] ABSTRACT

A system (12) operative with at least one electromagnetic wave to produce a circularly polarized wave includes a plurality of polarizer sections (56) disposed along a direction of propagation of one electromagnetic wave. The polarizer sections have opposed rows of phase shifting elements, in the form of rods (76), which are adjusted to provide a match to the orthogonal components of the wave. Penetration and spacing of phase shifting elements within each of the polarizing sections attains a match to the two orthogonal components of the wave and a differential phase shift between the two orthogonal components slightly in excess of a desired 90 degree orthogonal phase relationship. Upon a differential counter rotation between a first and a second of the polarizer sections, the total phase shift introduced by the polarizer sections is reduced to 90 degrees without significant shift in the match of the two orthogonal components. The equality of the amplitudes of the two orthogonal components is attained by a rotation of the polarizer (42) with respect to the orthomode transducer (34). This provides for a precise generation of a circularly polarized wave. In a satellite communication system, the polarizer system is installed between an ORTHOMODE transducer (34) and a feed (24) of an antenna (22) for operation concurrently with clockwise and counterclockwise circularly polarized waves.

8 Claims, 3 Drawing Sheets

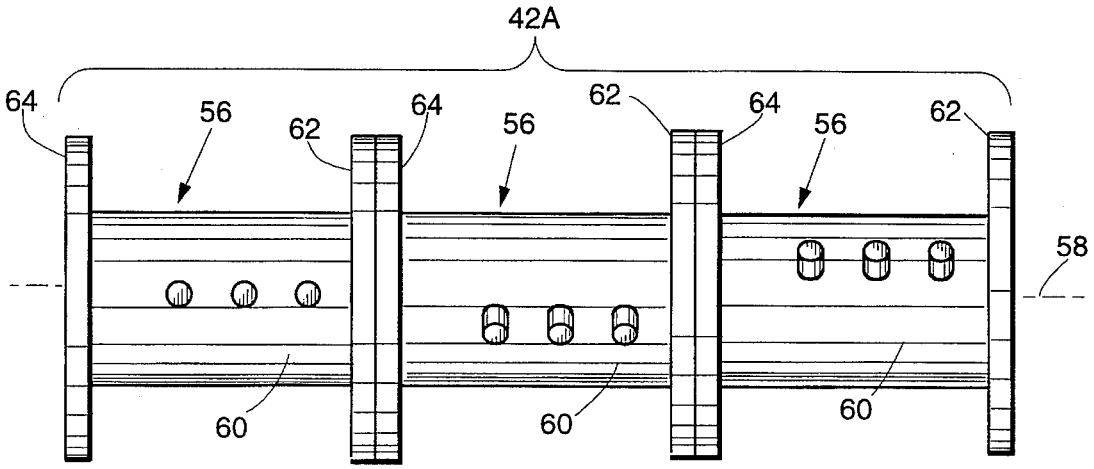
FIG. 2.
FIG. 3.
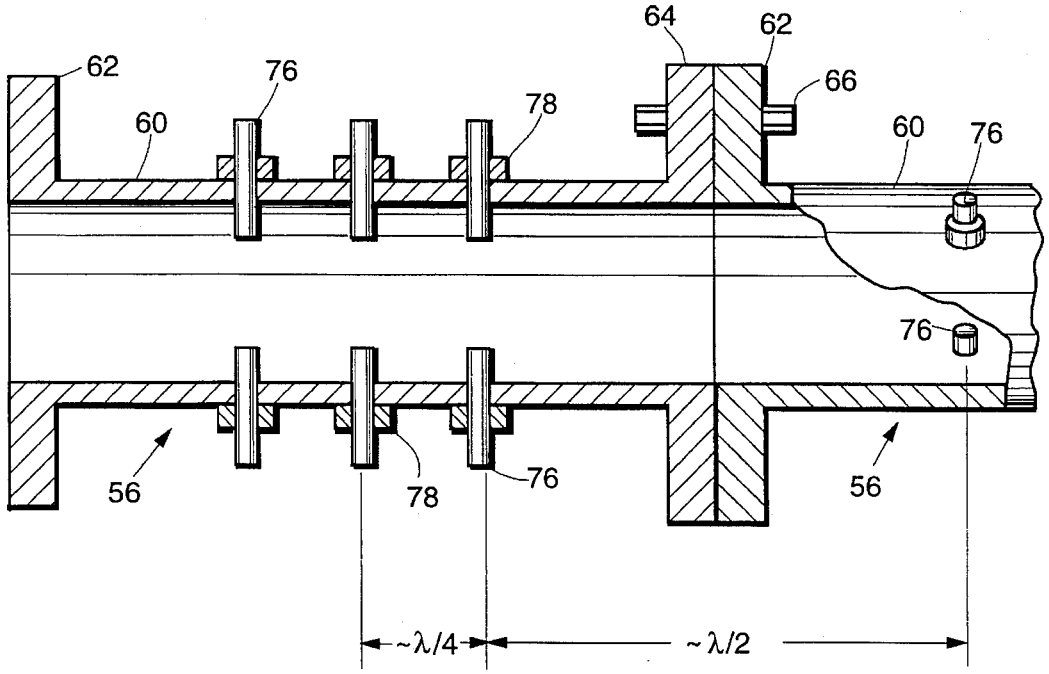

TANDEM CIRCULAR POLARIZER

BACKGROUND OF THE INVENTION

This invention relates to a polarizer system for generating circularly polarized electromagnetic waves, the polarizer system being suitable for converting a linearly polarized electromagnetic wave to a circularly polarized electromagnetic wave, and more particularly, to a polarizer system constructed of a plurality of polarizer sections arranged serially along a direction of propagation of an electromagnetic wave. Individual ones of the polarizer sections are rotated relative to each other for adjustment of differential phase between orthogonal components of an incident linearly polarized electromagnetic wave. An assembly consisting of the plurality of polarizer sections is rotated relative to the linearly polarized electromagnetic wave for adjustment of relative amplitude between the orthogonal components of the linearly polarized electromagnetic wave.

A situation of particular interest is the use of a polarizer in a satellite communication system. It is common practice in a satellite communication system to transmit data via a circularly polarized electromagnetic wave. However in practice, a precisely formed circularly polarized electromagnetic wave is hardly ever realized although the design of the polarizer is motivated to produce a circularly polarized wave. Therefore, an elliptically polarized approximation to a circularly polarized electromagnetic wave is used as a compromise so long as a specified axial ratio, namely a measure of the maximum to minimum amplitude of the elliptically polarized electromagnetic wave, is not exceeded. The specification of maximum axial ratio limits an interference between two oppositely polarized electromagnetic waves utilizing the same frequency, known in the satellite community as frequency re-use. By way of example, a linearly polarized electromagnetic wave available from the output of a rectangular waveguide is impressed into a polarizer comprising a two-fold symmetric waveguide (having square or circular cross section, by way of example) by means of a rectangular to two-fold symmetric waveguide transition. The polarizer introduces a 90 degree differential phase shift between equal amplitude orthogonal components of the impressed linearly polarized electromagnetic wave, thereby converting the linearly polarized electromagnetic wave into a circularly polarized electromagnetic wave. The polarizer operates in reciprocal fashion so that the microwave circuit can be employed both for transmission and reception of microwave signals. An ORTHOMODE transducer may be employed in place of the rectangular to two-fold symmetric waveguide whereby two orthogonal linearly polarized electromagnetic waves are available as input to the polarizer. In this case, the polarizer converts a first of the linearly polarized electromagnetic waves into one sense (right hand) of circularly polarized wave, and converts the second of the linearly polarized electromagnetic waves into the opposite sense (left hand) of polarized electromagnetic wave.

A problem arises in that some presently designed polarizers are operative based on an adjustment of the penetration of phase shifting elements into the sidewalls of the waveguide of the polarizer. This adjustment simultaneously affects both the differential phase shift and, by way of differential impedance mismatch, the relative amplitudes between the orthogonal components of a linearly polarized electromagnetic wave. For purposes of explanation, an impedance mismatch occurs when the reflections from the individual phase shifting elements do not cancel. This is disadvantageous in that, upon adjustment of the penetration of phase shifting elements so as to effectively produce a 90 degree differential phase shift between the orthogonal components of the linearly polarized electromagnetic wave, an equal amplitude ratio may no longer be present between the orthogonal components of the linearly polarized electromagnetic wave due to the impedance mismatch. For circular polarization, equality of the amplitudes of the orthogonal components and a 90 degree differential phase shift between the orthogonal components of the linearly polarized wave is required; otherwise, the electromagnetic wave is an elliptically polarized electromagnetic wave.

It has been the practice in tuning polarizers to expend a large amount of time either tuning or collecting empirical data, to overcome the foregoing disadvantages. By way of example, one adjustable phase shifting element in common use is a tuning screw penetrating the wall of the waveguide of the polarizer. This method usually requires a considerable amount of tuning time followed by post tuning soldering to avoid excess insertion loss and to prevent further movement of the tuning screws. However, soldering is not acceptable in situations where passive intermodulation (PIM) may arise. For example, a cracking in the solder may introduce such PIM. Another common method of adjusting phase shifting elements is the use of electrode discharge machining (EDM) which enables precise manufacture of intricate shapes to produce permanently installed elements such as electroformed or dip brazed pins or irises. This has the disadvantage of being nonreversible, expensive, and requiring considerable tuning time and prior collection of empirical data. In many situations where adjustable or post-fabrication tuning is not an alternative, there is often a requirement for excessively tight tolerances in order to meet performance requirements. This certainly increases the cost of manufacture.

SUMMARY OF THE INVENTION

The aforementioned problems are overcome and other advantages are provided by a circular polarizing system comprising a set of two or more polarizer sections arranged serially along a direction of propagation of an electromagnetic wave, in accordance with the invention, to provide adjustment of relative phase and of relative amplitude between the orthogonal components of a linearly polarized electromagnetic wave. In a preferred embodiment of the invention, each polarizer section is composed of two fixed series of phase shifting elements disposed in a sidewall of a section of circular waveguide, and being located within a longitudinal plane of the circular waveguide. One of the series of phase shifting elements is arranged diametrically opposed to the second series of phase shifting elements. The polarizer sections are spaced a distance apart so as to minimize interactions through evanescent modes.

A circularly polarized wave can be represented by two linearly polarized waves of equal amplitude which have space and phase (time) quadrature. The effect of this space and time quadrature is the apparent rotation of the electric and magnetic fields of the circularly polarized electromagnetic wave. The rotation can be either clockwise or counterclockwise corresponding to the two screw senses, right hand and left hand. By definition, the electric field of a right hand circularly polarized wave rotates clockwise as a function of time at a fixed point in space when viewed in the direction of propagation as if it were following the threads of a right hand screw. The electric field of a left hand circularly polarized wave rotates counterclockwise as a function of time at a fixed point in space when viewed in the direction of propagation as if it were following the threads of a left hand screw. The direction of rotation or screw sense is a consequence of whether the 90 degree differential phase is positive or negative.

In accordance with the invention, the operation of the polarizer system may be understood by considering, by way of example, a situation, wherein two identical polarizer sections are disposed with all of the phase shifting elements arranged coplanar introducing a differential phase shift of greater than 90 degrees (e.g. 100 degrees) and wherein the plane containing the phase shifting elements is disposed at a 45 degree angle with respect to the electric field of an incident linearly polarized electromagnetic wave. For explanation purposes, the incident linearly polarized electromagnetic wave is considered composed of two in-phase orthogonal components wherein a first of the components is parallel to the plane containing the phase shifting elements, designated as the parallel component, and wherein the second of the components is perpendicular to the plane containing the phase shifting elements, designated as the perpendicular component. The parallel and the perpendicular components are of equal amplitude because the plane containing the phase shifting elements is disposed at a 45 degree angle with respect to the electric field of the incident electromagnetic wave. Operation of the phase shifting elements is based on their respective depths of penetration into a section of waveguide and on their respective longitudinal spacings relative to adjacent phase shifting elements in each of the polarizer sections. The phase shifting elements affect predominantly the differential phase shift between the parallel and the perpendicular components, and by way of design, affect minimally the amplitudes of the parallel and the perpendicular components. That is to say, the mismatch is essentially independent of any rotation of the polarizer sections with respect to an incident electromagnetic wave.

In the foregoing example wherein the phase shifting elements of a first of the polarizer sections are coplanar with the phase shifting elements of the second polarizer section, the polarizer system, as it is adjusted by adjustment of the penetration of the phase shifting elements, may produce an elliptically polarized electromagnetic wave resulting from a production of differential phase between the parallel and the perpendicular components in excess of the desired 90 degrees. However, in accordance with the invention, upon introducing a rotation of the first polarizer section with respect to the second polarizer about their common longitudinal axis, so as to introduce a relatively small differential rotation on the order of possibly 5–10 degrees, the effective differential phase shift is reduced and the 90 degree differential phase shift is obtained. By way of further explanation, the maximum differential phase shift between parallel and perpendicular components is obtained when the phase shifting elements in both of the polarizer sections are coplanar. The minimum differential phase is obtained when the phase shifting elements of the first polarizer section are perpendicular to the phase shifting elements of the second polarizer section. Thus, a differential phase shift comprising the difference of the differential phase of the individual polarizer sections and the sum of the differential phases of the individual polarizer sections can be obtained. In the foregoing example, the difference of the differential phases of the individual polarizer sections and the sum of the differential phase of the individual polarizer sections was given as 100 degrees, this exceeding the required 90 degree differential phase shift. It is understood that the polarizer system is rotated relative to the incident linearly polarized electromagnetic wave for adjustment of equal amplitude between orthogonal components of the linearly polarized electromagnetic wave.

Thereby the polarizer system of the invention, by virtue of the differential rotation between polarizer sections, is able to provide for an independent adjustment of differential phase shift between the two component waves essentially without alteration of the relative amplitudes due to mismatch of the two component waves over the foregoing angle of differential rotation. It is assumed in the foregoing example that equality of amplitudes of the two component waves has been obtained by the polarizer system at a differential phase shift between the two waves of 100 degrees, while the differential phase shift should be 90 degrees in order to have the desired phase quadrature relationship between the two component waves. Thus, introduction of the foregoing small differential rotation between the two waveguide sections would provide 10 degrees less phase shift, this reducing the differential phase shift between the two components to the desired 90 degrees.

BRIEF DESCRIPTION OF THE DRAWING

The aforementioned aspects and other features of the invention are explained in the following description, taken in connection with the accompanying drawing wherein:

FIG. 2 is a plan view of an alternative embodiment of the polarizer of FIG. 1, the embodiment of FIG. 2 having three sections while the embodiment of FIG. 1 has only two sections;

FIG. 3 is a fragmentary side view of the polarizer of FIG. 1, the view being partially cut away and sectioned to show details in the mounting of phase shifting elements in the sections of the polarizer;

Identically labeled elements appearing in different ones of the figures refer to the same element in the different figures.

DETAILED DESCRIPTION

Figure 1:
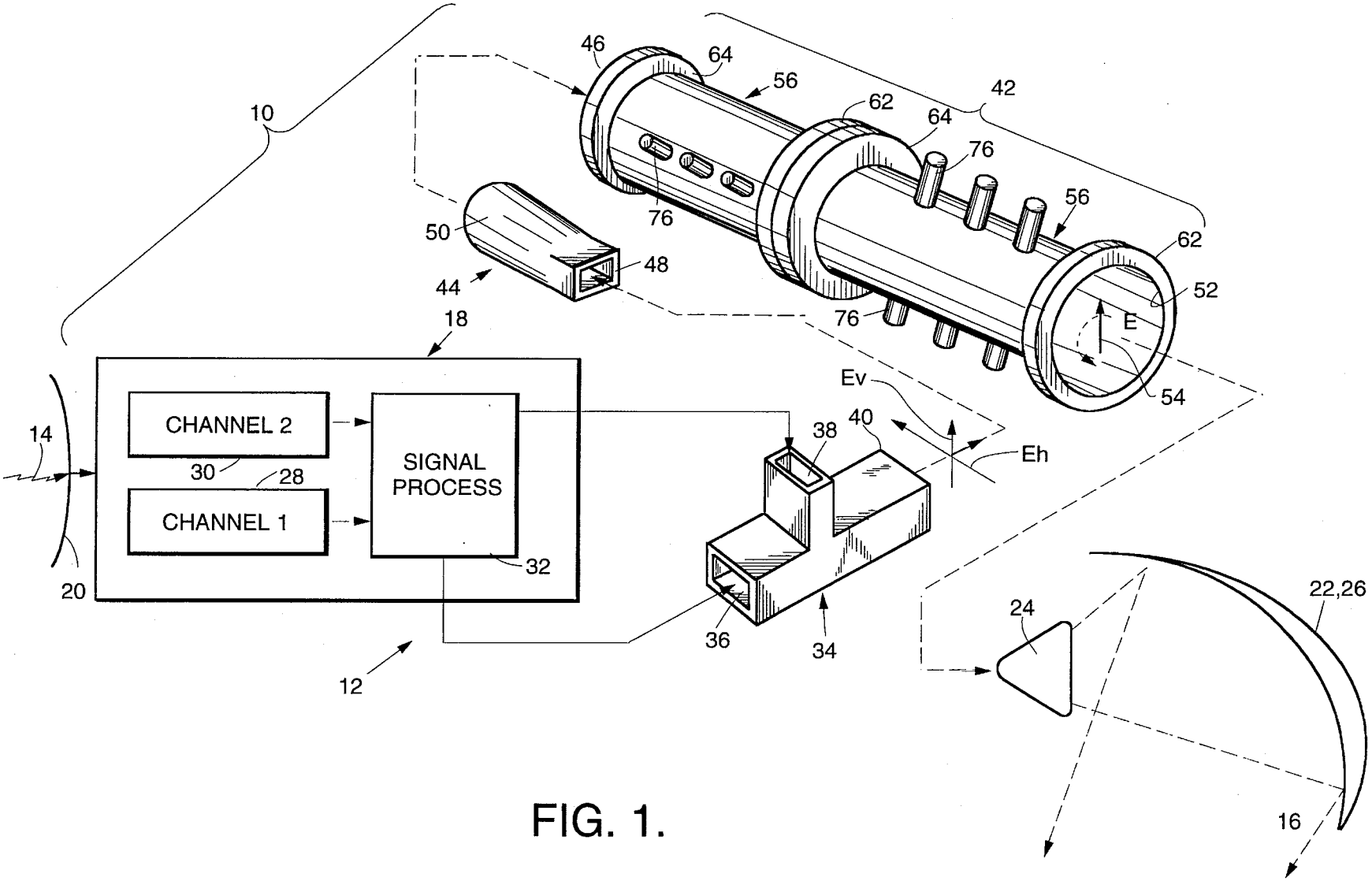
FIG. 1 is a stylized view, partially diagrammatic, of a satellite communication system including a circular polarizer constructed in accordance with the invention.

FIG. 1 shows a satellite 10 transporting microwave circuitry of a communication system 12 for receiving up-link electromagnetic signals 14 from the earth, and for retransmitting data of the up-link signals in a down-link electromagnetic signal 16 back to the earth. The up-link signal 14 is received by a receiving system 18 via an antenna 20. The down-link signal is transmitted via an antenna 22 comprising a feed 24 and a reflector 26 which directs rays of radiation emanating from the feed 24 as a beam of the down-link signal 16. The feed 24 may be constructed as a frustoconical corrugated horn for transmission of circularly polarized waves.

The communication system 12 is fabricated in a well-known manner wherein the receiving system 18 is adapted for receiving a circularly polarized signal having two orthogonal signal channels. The signals of the two channels 28 and 30 are applied to a signal processor 32 of the receiving system 18 for amplification and filtering of the signals, and are then outputted to an ORTHOMODE transducer 34. By way of example, the transducer 34 is constructed of rectangular waveguide, and includes a straight input port 36 for receiving the signal of the first channel 28 and a side input port 38 for receiving the signal of the second channel 30. The transducer 34 further comprises a two-fold symmetric (square or circular) shaped output port 40 coupled in well-known fashion to the input ports 36 and 38 such that the signal of the first channel 28 is outputted with a vertically polarized electric field, and the signal of the second channel 30 is outputted with a horizontally polarized electric field.

Also included within the communication system 12 is a circular polarizer 42 constructed in accordance with the invention, and a transition 44 interconnecting the output port 40 of the transducer 34 to an input port 46 of the polarizer 42. The transition 44 has a two-fold symmetric cross-sectional configuration at a front end 48 thereof for mating with the transducer 34, and a circular cross-sectional configuration at the back end 50 thereof for mating with the polarizer 42. The transition 44 provides for a conversion from the waveguide modes of electromagnetic signals at the waveguide output port 40 of the transducer 34 to the waveguide modes within the circular waveguide of the polarizer 42. An output port 52 of the polarizer 42 connects with the horn 24. The electric fields of the waves of the signals of the two channels 28 and 30 have a spatially orthogonal relationship to each other, as outputted by the transducer 34, and are incident upon the polarizer 42 via the transition 44. The polarizer 42 is operative to introduce a 90 degree phase shift between two orthogonal component waves of the vertically polarized wave to produce a resulting circularly polarized electromagnetic wave of a first hand, indicated at 54 wherein the electric field, E, has rotation indicated by the dashed semicircular arrow. Similarly, the polarizer 42 is operative to introduce a 90 degree phase shift between two orthogonal component waves of the horizontally polarized wave to produce a resulting circularly polarized electromagnetic wave of a second hand opposite to the first hand.

In accordance with the invention, and with reference to FIGS. 1–6, the circular polarizer 42 is constructed as a system of polarizer sections 56 wherein a series of the polarizer sections 56 is arranged in tandem along a central longitudinal axis 58. By way of example, in the preferred embodiment of the invention, the polarizer 42 is provided with two of the sections 56 as shown in FIG. 1. However, if desired, additional ones of the sections may be provided such that, in the alternative embodiment 42A of the circular polarizer, as shown in FIG. 2, the polarizer 42A is provided with three of the sections 56 disposed in tandem about a central longitudinal axis 58 of the polarizer 42A. Each polarizer section 56 is constructed of a section 60 of circular waveguide terminated by a front flange 62 and a back flange 64, the flanges 62 and 64 serving for joining together the polarizer sections 56.

Figure 4:
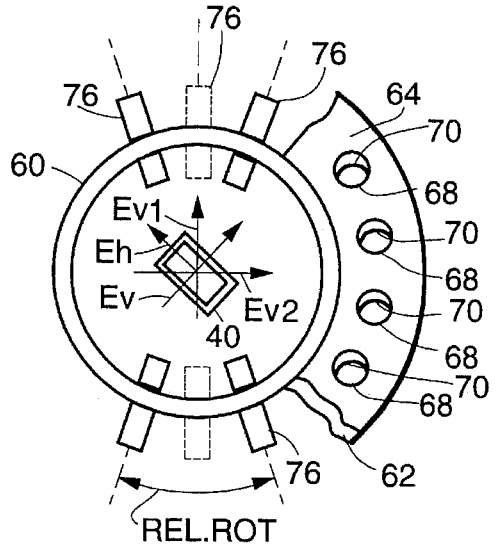
FIG. 4 is a stylized end view of the polarizer of FIG. 2 shown superposed upon an output port of an ORTHOMODE transducer of FIGS. 1 or 2 with portions of flanges being broken away to facilitate viewing of an arrangement of the phase shifters in two contiguous sections of the polarizer, and wherein phase shifting elements Of a third section of the polarizer of FIG. 2 are indicated in phantom in FIG. 4.
Figure 5:
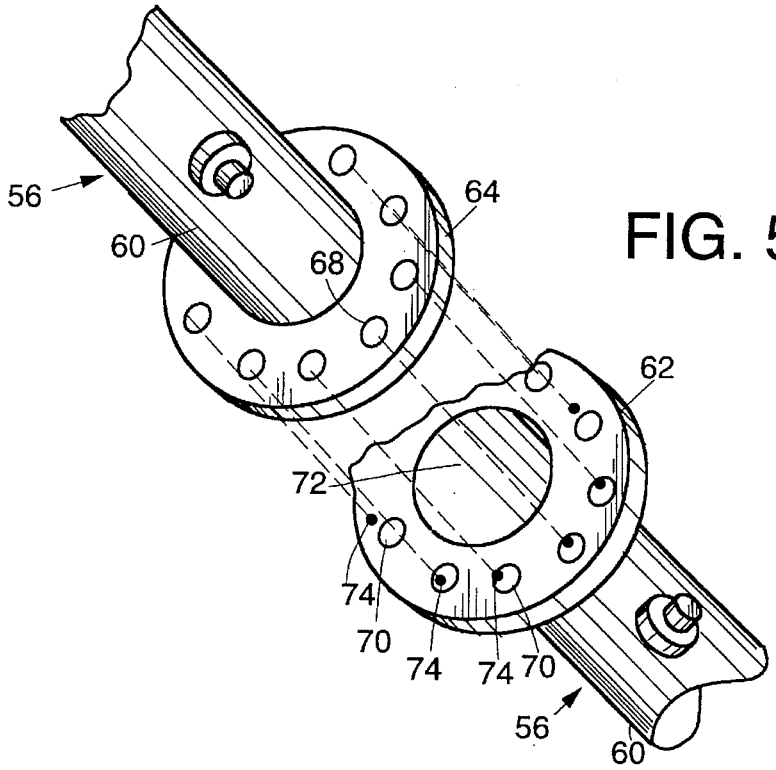
FIG. 5 is an exploded fragmentary view of the polarizer of FIG. 1 showing a vernier arrangement of holes in opposed flanges wherein a slight relative rotation of the two polarizer sections produces alignment between the next set of mounting holes for receipt of a dowel pin.

In accordance with a feature of the invention, the polarizer sections 56 are rotatable relative to each other, and may be locked at a desired position of relative rotation by means of a dowel pin 66 (FIG. 3) passing through a hole 68 in a back flange 64 and a hole 70 in a front flange 62 wherein the holes 68 and 70 are in alignment. The holes 68 and 70 are arranged in the manner of a vernier such that, by way of example, the flange 64 has a number, n, holes 68 and the flange 62 has a number, n+1, holes 70. As a result, only one pair of holes 68 and 70 can be in alignment at any one time. A pair of aligned holes is indicated by a dashed line 72 in FIG. 5. The successive offsetting from alignment at a succession of the holes 68 and 70 is shown in the fragmentary view of the back flange 64 (FIG. 4) superposed upon a fragmentary portion of a front flange 62. In FIG. 5, dots 74 at the ends of dashed lines threading the holes 68 indicate projections of the centers of the holes 68 upon the flange 62 to show how the vernier alignment of the holes 70 are offset successively from the center lines of the holes 68.

By way of example, if there are 30 holes within the flange 64, the holes are positioned at intervals of 12° around the flange. Then there are 31 holes within the flange 62, these holes being positioned at intervals of 11.613° around the flange. The vernier arrangement provides for minute relative rotational adjustment between a pair of abutting flanges 62 and 64. Each vernier position provides for an adjustment of 0.387° (12° minus 11.613°) of relative rotation between two abutting flanges 62 and 64. The dowel pin 66 is used to lock the relative rotational positions of two consecutive polarizer sections 56. Additional fasteners (not shown) would be employed to secure the polarizer sections 56 in their longitudinal direction of the polarizer 42 or 42A.

Figure 6:
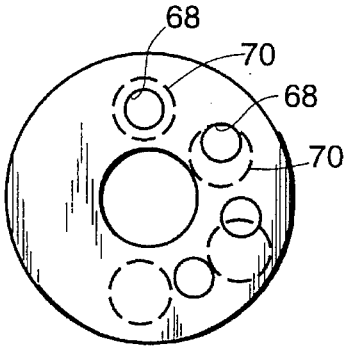
FIG. 6 is a diagrammatic end view of the polarizer of FIG. 1 showing the vernier arrangement of the holes, and wherein the phase shifting elements are deleted to simplify the drawing.

The operation of the vernier is explained further in FIG. 6 in which the succession of holes 68 is represented by solid circles of relatively small diameter and the succession of holes 70 is represented by dashed circles of relatively large diameters. While it is understood that the diameters of the holes 68 and 70 are equal, the diagrammatic representation of the holes 68 and 70 employs different sized holes of FIG. 6 to facilitate showing the successive offsetting of the positions of the holes provided by the vernier arrangement.

By way of alternative embodiments of the vernier, it is noted that, if desired, the succession of n holes in one flange and the n+1 holes in the abutting flange may be provided as a repeating pattern which repeats once during each 180 degrees of rotation about a flange. This would provide for two complete vernier series in one rotation of 360 degrees about a flange. In such case, there would be two diametrically opposed locations of holes which are in alignment with each other, and two of the dowel pins 66 could be employed in diametrically opposed positions about the polarizer 42 for securing contiguous polarizer sections 56. By way of further embodiment, if desired, the vernier arrangement of mounting holes can be repeated through three cycles of 120 degrees during one revolution about a pair of abutting flanges. In this case, there would be three sets of aligned holes positioned 120 degrees about a pair of abutting flanges 62 and 64 allowing for a total of three of the dowel pins 66 to secure contiguous polarizer sections 56. However, in such case, the amount of adjustment on the relative rotational positions of contiguous polarizer sections 56 becomes smaller as compared to the continuous adjustment provided by a single vernier arrangement of mounting holes extending through a complete revolution about a pair of abutting flanges 62 and 64, as has been described for the preferred embodiment of the invention.

In the depicted embodiment of FIG. 3, each polarizer section 56 is provided with six phase shifting elements in the form of rods 76. There are two sets of the rods 76, each set having three of the rods 76. In each set, the three rods 76 are arranged in a straight line and are spaced apart appropriately so as to provide an impedance match to the incident electromagnetic wave ensuring equal amplitude in components perpendicular and parallel to the pins, such spacing between the rods 76 being generally in the range of approximately one-quarter of the guide wavelength. The rods 76 extend into a sidewall of the waveguide section 60 along radii of the waveguide section 60. The two sets of rods 76 are symmetrically disposed relative to each other on opposite sides of the waveguide section 60 with a rod 76 of one set being diametrically opposed to the corresponding rod 76 of the other set. A threaded mount 78 engages with threads of each of the rods 76 to provide for advancement of a rod 76 towards the axis 58 or retraction of a rod 76 away from the axis 58 by rotation of the rod 76 within its mount 78. This provide a means of setting the extension of the rods 76 into the sidewall of the waveguide section 60 during fabrication of the circular polarizer 42. In the arrangement of successive ones of the polarizer sections 56, a spacing of approximately one-half of the guide wavelength is maintained between the back end of one set of rods 76 and the front end of the next set of rods 76, this being indicated in FIG. 3. The spacing mitigates interaction between evanescent fields of contiguous polarizer sections.

In the operation of the circular polarizer 42, in accordance with the invention, the pins 76 introduce a differential phase shift to a linearly polarized wave incident on the polarizer 42, and having a nonzero component parallel to the plane of the set of pins of a polarizer section. In particular, the pins 76 interact with an electric field, or a component thereof, disposed parallel to the common plane of the set of the six pins 76 within a polarizer section 56. The amount of phase shift may be increased by advancement of the pins 76 into the waveguide section 60 of the polarizer section 56, and the amount of phase shift introduced may be reduced by retraction of the pins 76.

As is well known, the interposition of a pin 76 within a section of waveguide can also affect the amplitude of an electromagnetic wave propagating along the waveguide section 60 due to mismatch caused by an improper setting of the extension of the rods 76 into the waveguide section 60 and an incorrect longitudinal spacing along the waveguide section 60. The amplitude interaction is generally largest for an electric field component lying in the plane of the pins 76. In accordance with a feature of the invention, the extension of the rods 76 into the waveguide section 60 and the longitudinal spacing of the rods 76 along the waveguide section 60 is designed so as to provide an impedance match to any incident electromagnetic wave of any rotational orientation and to provide a maximum differential phase in excess of the required 90 degrees when the plurality of polarizer sections 56 are combined. To facilitate a showing of these relationships, FIG. 4 presents a diminutive view of the output port 40 of the ORTHOMODE transducer 34 with the electric fields indicated as arrows identified as Ev and Eh identifying respectively the vertically and horizontally polarized electric fields. In the view of FIG. 4, the pins 76 shown in solid lines are pins of the two sections 56 of the polarizer 42 of FIG. 1. The pins 76 shown in solid lines also represent the pins of the right and central polarizer sections 56 of the polarizer 42A of FIG. 2 while the pins 76 in dashed lines represent the pins of the left section 56 of the polarizer 42A. Also shown in FIG. 4 is a component of the vertical field Ev1 which is parallel to the plane of the set of pins 76 and a component of the vertical field Ev2 which is perpendicular to the set of the pins 76. Corresponding components Eh1 and Eh2 (not shown) are provided for the horizontally polarized electric field vector.

In accordance with a feature of the invention, the maximum available phase shift of a polarizer section is somewhat greater, by a few degrees, typically, than that which is required to provide the requisite 90 degrees total phase shift by all of the sections of the polarizer. Upon introduction of differential rotational offset between the polarizer sections, the average contribution of phase shift by all of the sections is reduced to obtain the desired total phase shift of 90 degrees.

For example, in the case of the polarizer 42A of three sections (FIGS. 2 and 4), each polarizer section 56 produces approximately one third of the total phase shift, this being equal to approximately 30 degrees. In practice, one of the polarizer sections 56, the left hand section 56 in FIG. 2, by way of example, is disposed with the plane of its pins 76 parallel to the field component Ev1. This is indicated by the dashed pins 76 in FIG. 4. The extensions of the rods 76 are designed and fabricated to provide for a differential phase shift of approximately 34 degrees, by way of example, in each of the three sections 56. The polarizer section 56 to the left in FIG. 2 has its pins 76 coplanar with the parallel field component Ev1, and therefore introduces its maximum phase shift contribution of 34 degrees between the field components Ev1 and Ev2. However, the center section 56 and the right section 56 of the polarizer are rotated relative to the left section. This results in a reduced differential phase shift of the center and the right sections . As a result, the phase shift contribution of each of the center and the right sections 56 is reduced to give a total phase shift of the desired 90 degrees.

In a similar manner, one can visualize the two section polarizer of FIG. 1 having both sections 56 in initial alignment (not shown) in which case all of the pins 76 are coplanar with the parallel field component Ev1. The total contribution of phase shift by the two sections 56 would be 100 degrees, for example, with each section 56 providing its maximum contribution of 50 degrees. Upon introduction of a rotational offset of each section 56 relative to the plane of the field component Ev1, wherein one section 56 is rotated clockwise and the other section 56 is rotated counterclockwise, the differential phase of each of the sections 56 are reduced. This results in a corresponding reduction in total differential phase shift by all of the sections 56 to give the desired total of 90 degrees of phase shift.

The invention provides for the advantage of equal amplitude between the orthogonal field components in each of the circularly polarized waves. This is accomplished by selecting the depths of penetration and the longitudinal spacing of the rods 76 to attain the desired differential phase shift and to attain a match essentially independent of any rotation of the polarizer section with respect to an incident electromagnetic wave. This ensures equality of amplitude between the orthogonal components. For example, in the case of the two section polarizer 42 of FIG. 1, it may be selected to introduce a total of 52° of phase shift per polarizer section 56. Upon introduction of a small rotational offset between the two sections 56, typically on the order of a few degrees to adjust the differential phase shift to 90 degrees, the effects of the rods 76 upon the match presented to the orthogonal fields of the incident linearly polarized waves remain substantially unchanged. The equality of the orthogonal components of the incident electromagnetic waves may be attained by the relative rotation of the polarizer 42 with respect to the plane containing the linearly polarized incident electromagnetic waves. Thereby, the invention allows for independent control over both relative phase and relative amplitude between the orthogonal field components. This enables the generation of circularly polarized waves to a high degree of accuracy.

Accordingly, with reference to the foregoing example, and by way of summary in the alignment of the polarizer 42, the plane of the pins 76 of one of the polarizer sections 56 would be rotated in the clockwise direction and the plane of the pins 76 of the other of the two sections 56 would be rotated in a counterclockwise direction relative to the plane of the parallel field component Ev1. As the rotation of the two polarizer sections 56 about their common axis 58 proceeds, it is noted that there is a decrease in the amount of differential phase shift introduced between the parallel and the perpendicular component fields Ev1 and Ev2. However, the effect on the relative amplitudes due to mismatch of the two component fields Ev1 and Ev2 remains substantially unchanged. Therefore, the introduction of the counter rotation between the two polarizer sections 56 acts to reduce the total phase shift to the desired 90 degrees while retaining the desired match to the orthogonal field components.

Thereby, the invention has obtained its objective of allowing for essentially independent control of amplitude and phase adjustment by use of the plural phase shift sections of the circular polarizer 42 without the need for additional corrective tuning structures as has been required by the prior art. This greatly simplifies tuning and alignment of microwave circuitry, such as the microwave circuitry of the satellite communication system 12. Upon attainment of the desired amount of rotation of one polarizer section 56 relative to the contiguous polarizer section 56 in the polarizer 42, a dowel pin 66 is inserted between a pair of aligned mounting holes 68 and 70 to retain the desired rotational orientation of the polarizer sections during subsequent assembly of the microwave circuitry.

It is noted that in order to attain the desired rotational orientation of the planes of the pins 76 of plural polarizer sections 56 about the parallel field component Ev1, it is necessary to provide rotation of the two polarizer sections 56 relative to each other and subsequent rotation of the entire assembly of the polarizer 42 relative to the transducer 34. Iteration of the rotation between the polarizer sections, and between the entire assembly and the transducer 34, minimizes the axial ratio. The necessary and sufficient condition for obtaining a zero decibel axial ratio of the amplitudes of the orthogonal electric field components of the circularly polarized waves is obtained by generating time quadrature between two equal electric field vectors in space quadrature. The differential rotation between polarizer sections controls the total differential phase of the tandem assembly independently of amplitude balance. Amplitude balance is ensured if the polarizer sections are designed to achieve impedance match over the frequency band of operation. Adjustment for mismatch can be achieved for one channel operation by rotating the polarizer structure with respect to the transducer 34, essentially increasing the amplitude of the component which undergoes an impedance mismatch.

In the case of the polarizer 42A of FIG. 2, the theory of operation is the same. In this case, since three polarizer sections 56 are employed to produce the total of 90° phase shift. The penetrations of the pins 76 in each of the sections 56 are set to attain a match to the incident electric field components. Thereupon, the central and the right hand sections 56 of the circular polarizer 42A are counter rotated to the locations shown by the solid rods 76, in FIG. 4, so as to reduce the total phase shift to 90 degrees while retaining a match to the incident field components. Upon attainment of the desired amount of rotation between the contiguous sections 56 of the polarizer 42A, dowel pins 66 are inserted between abutting flanges 62 and 64 of the contiguous sections to retain the desired rotational orientations during completion of the microwave circuit.

It is noted that the theory of the invention applies also to a polarizer having other forms of phase shifting elements such as dielectric slabs, posts and irises (not shown), by way of example. The theory applies also to a polarizer (not shown) whereby the differential phases of each of the polarizer sections are not equal. The theory applies also to a polarizer having four sections or even more sections (not shown) in which case the amount of phase shift is divided among the various polarizer sections. In the foregoing description, alignment of the polarizer is based on the field components of the linearly polarized electric field Ev, however the alignment of the polarizer can be accomplished also with reference to the electric field Eh.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A polarizer system operative with an electromagnetic wave to introduce a predetermined relative amplitude and a predetermined relative phase between orthogonal components of said wave, the system comprising:

a first polarizer section and a second polarizer section disposed in tandem along a path of propagation of said waves and being rotatable relative to each other about a longitudinal axis extending through said first and said second polarizer sections, said longitudinal axis being parallel to said path of propagation;

wherein each of said polarizer sections comprises a section of waveguide extending along said longitudinal axis, an adjustable phase shift means positioned for interaction with said wave within said section of waveguide, said interaction with said wave being dependent on an orientation of said polarizer section about the longitudinal axis relative to a direction of polarization of said wave;

each of said first and said second polarizer sections is oriented approximately at a selected orientation which provides equal interaction with orthogonal components of said wave;

said first and said second polarizer sections are offset in opposite directions from said selected orientation by rotation about said longitudinal axis to provide a predetermined amount of phase shift between said orthogonal components concurrently with a predetermined ratio of amplitudes of said orthogonal components; and a third polarizer section being rotated about said axis to an orientation closer to said selected orientation than said first and said second polarizer sections.

2. A system according to claim 1 wherein said adjustable phase shift means comprises a plurality of phase shift elements penetrating said section of waveguide in a direction perpendicular to said longitudinal axis.

3. A system according to claim 2 wherein in each of said polarizer sections, there is a first row of said phase shift elements extending within a plane parallel to said longitudinal axis and comprising a plurality of said phase shift elements, there being a second row of said phase shift elements disposed in said plane diametrically opposite said first row of phase shift elements.

4. A system according to claim 3 wherein each of waveguide sections is formed as a hollow waveguide bound by an encircling sidewall, and wherein each of said phase shift elements is mounted displaceably within said sidewall to allow for a variable amount of penetration of the phase shift element within the waveguide section.

5. A system according to claim 1 wherein rotation of said first and said second polarizers from said selected orientation provides for an equality of amplitude of said orthogonal components and a phase quadrature relationship between said orthogonal components.

6. A system according to claim 1 wherein said third polarizer section has an orientation coinciding with said selected orientation.

7. A system according to claim 6 wherein the orientations of said first and said second and said third polarizer sections provide for substantial equality in amplitudes of said orthogonal components and a phase quadrature relationship between said orthogonal components.

8. A system according to claim 1 further comprising vernier means coupling said first polarizer section and said second polarizer section for fine adjustment of angular rotation between said first polarizer section and said second polarizer section about said longitudinal axis.

* * * * *